US007036184B2

(12) United States Patent
Kim

(10) Patent No.: US 7,036,184 B2
(45) Date of Patent: May 2, 2006

(54) ACCESSORY TOOL ASSEMBLY FOR VACUUM CLEANER

(75) Inventor: Sung-Guen Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 302 days.

(21) Appl. No.: 10/367,710

(22) Filed: Feb. 19, 2003

(65) Prior Publication Data

US 2004/0066771 A1 Apr. 8, 2004

(30) Foreign Application Priority Data

Oct. 7, 2002 (KR) ..... 10-2002-0061059

(51) Int. Cl.
*A47L 9/06* (2006.01)

(52) U.S. Cl. ..... 15/397; 15/398; 15/400; 15/415.1

(58) Field of Classification Search ..... 15/397, 15/402, 396, 398, 400, 414, 415.1, 373
See application file for complete search history.

(56) References Cited

U.S. PATENT DOCUMENTS 925,646 A * 6/1909 Moorhead ..... 15/397
3,259,934 A * 7/1966 Leinfelt ..... 15/414
4,573,237 A * 3/1986 Kochte et al. ..... 15/414
5,345,651 A * 9/1994 Roberts ..... 15/397
5,768,745 A * 6/1998 Lee ..... 15/373
6,484,357 B1 * 11/2002 Dong ..... 15/397
6,519,810 B1 * 2/2003 Kim ..... 15/414
6,820,305 B1 * 11/2004 Albert et al. ..... 15/398

FOREIGN PATENT DOCUMENTS

KR 20-1995-0008118 4/1995

OTHER PUBLICATIONS

Korean Action dated Sep. 15, 2004.

* cited by examiner

*Primary Examiner*—Theresa T. Snider
(74) *Attorney, Agent, or Firm*—Fleshner & Kim, LLP

(57) ABSTRACT

An accessory tool for a vacuum cleaner is provided which allows a small crevice to be easily cleaned, and for accessory tools to be easily changed based on places to be cleaned. The accessory tool includes a crevice tool detachably coupled to a brush tool. The crevice tool includes a plurality of suction tubes made of a flexible material extending from a front portion of an inlet, and a brush provided along a periphery of each of the suction tubes. A coupling portion is formed to the rear of the inlet, and is detachably coupled with an inlet formed at a front portion of the brush tool. A brush is provided along a periphery of the inlet, and connecting portion formed to the rear of the inlet connects to an end of an extension tube of the vacuum cleaner.

23 Claims, 4 Drawing Sheets

ACCESSORY TOOL ASSEMBLY FOR VACUUM CLEANER

BACKGROUND OF THE INVENTION

1. Field of the Invention

The present invention relates to an accessory tool assembly for a vacuum cleaner, and more particularly, to an accessory tool assembly for a vacuum cleaner, in which an octopus-leg like tool, or crevice tool, with a plurality of flexible suction tubes is detachably coupled with a brush tool so as to clean a small crevice and reduce inconvenience of exchanging the octopus-leg like tool, or crevice tool, and the brush tool with each other depending on a place to be cleaned.

2. Description of the Prior Art

FIG. 1 shows the constitution of a general vacuum cleaner. As shown in the figure, a main body 10 of the vacuum cleaner houses a suction means (not shown) for sucking air in a room and a filtering means (not shown) for filtering out foreign substances from the air sucked by the suction means. A suction hose 12 is connected to the main body 10.

The suction hose 12 is made of a flexible material, and an operating handle 14 for controlling an operation of the vacuum cleaner is connected to one end of the suction hose 12. Then, the operating handle 14 is connected to a suction nozzle 18 through an extension tube 16.

The suction nozzle 18 sucks foreign substances from a place to be cleaned by means of suction power generated by the suction means in the main body. Since the suction nozzle 18 has a bottom face in the form of a broad and substantially flat plate, however, there is a structural limitation in applying the suction power to places such as upholstery or window frames.

A variety of accessory tools have been used to solve the problem. For example, typical accessory tools include a blade-type tool with a pointed inlet end, a brush tool with a brush attached at an inlet thereof, and the like.

As shown in FIG. 2*a*, the blade-type tool 20 comprises a pointed inlet 22, and a connecting portion 24 to be connected to one end of the extension tube 16 (refer to FIG. 1). As shown in FIG. 2*b*, a brush tool 30 comprises an inlet 32 formed at a front portion thereof to suck outside air, a brush 34 provided along a periphery of a front face of the inlet 32, and a connecting portion 36 to be connected to the end of the extension tube 16 (refer to FIG. 1).

In order to perform cleaning by using the accessory tool such as the blade-type tool 20 or the brush tool 30, the suction nozzle 18 connected to the end of the extension tube 16 shown in FIG. 1 is first separated therefrom, and the accessory tool is connected to the end of the extension tube 16.

Therefore, even a deep portion in a small crevice such as a window frame can be cleaned by using the blade-type tool 20, and the brush 34 provided at the brush tool 30 facilitates suction of foreign substances from upholstery or a sofa which it is difficult to clean by using the suction nozzle 18.

However, there are problems in the conventional accessory tools for the vacuum cleaner constructed as such, as follows.

First, the blade-type tool 20 is useful for cleaning of a crevice, such as the window frame or a chink in a door, larger than the inlet 22. However, if a crevice such as in a keyboard of a computer is smaller than the inlet 22, the inlet 22 cannot come into contact with a deepest portion of the crevice. Therefore, there is a disadvantage in that since strong suction power is not transferred up to the deepest portion, the cleaning cannot be performed effectively.

Further, although the blade-type tool 20 can be used for the cleaning of such a crevice, it is not effective in the cleaning of upholstery and the like. On the contrary, although the brush tool 30 is suitable for the cleaning of the upholstery and the like, it is not suitable for the cleaning of the small crevice. Accordingly, a user should separate the blade-type tool 20 or brush tool 30 from the end of the extension tube 16 depending on features of places to be cleaned and then connect the brush tool 30 or blade-type tool 20 to the end of the extension tube 16. Thus, there is a disadvantage in that its use is troublesome.

SUMMARY OF THE INVENTION

The present invention is contemplated to solve the problems in the prior art. An object of the present invention is to provide an accessory tool for a vacuum cleaner capable of efficiently performing cleaning of a small crevice or a place with a large number of grooves formed thereon.

Another object of the present invention is to provide an accessory tool for a vacuum cleaner capable of reducing cumbersome exchange of accessory tools depending on features of a place to be cleaned.

According to the present invention for achieving the objects, there is provided an accessory tool assembly for a vacuum cleaner, comprising octopus-leg like tool, or crevice tool, including an inlet with a plurality of suction tubes, and a coupling portion formed at a side opposite to the inlet to communicate with the inlet; and a brush tool including an inlet which is formed at a front portion of the brush tool and to which the coupling portion is detachably coupled, a brush provided along a periphery of the inlet of the brush tool, and a connecting portion formed at a side opposite to the inlet of the brush tool to be connected to an extension tube of the vacuum cleaner and to communicate with the inlet of the brush tool.

According to the present invention, the suction tubes are preferably made of a flexible material to be flexed in accordance with sizes or shapes of crevices to be cleaned. Thus, a variety of crevices can be cleaned.

According to the present invention, front faces of the suction tubes are preferably provided with brushes made of a flexible material. Thus, it is possible to sweep dirt in a crevice to be cleaned.

With the accessory tool for the vacuum cleaner of the present invention, there are advantages in that even a small crevice such as in a keyboard of a computer can be cleaned efficiently and the octopus-leg like tool, or crevice tool, and the brush tool can be conveniently exchanged with each other depending on features of places to be cleaned.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 3:
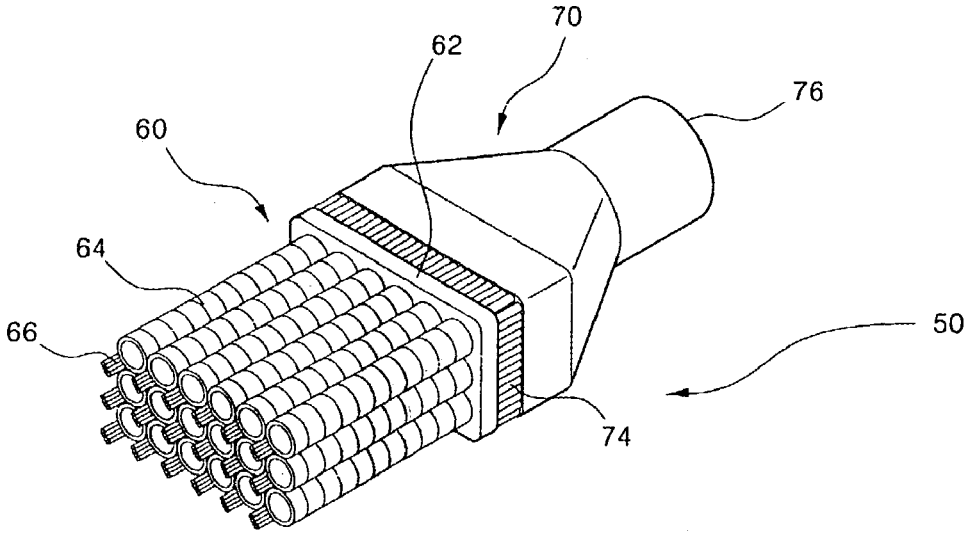
FIG. 3 is an exemplary perspective view of an accessory tool for the vacuum cleaner according to the present invention.
Figure 4:
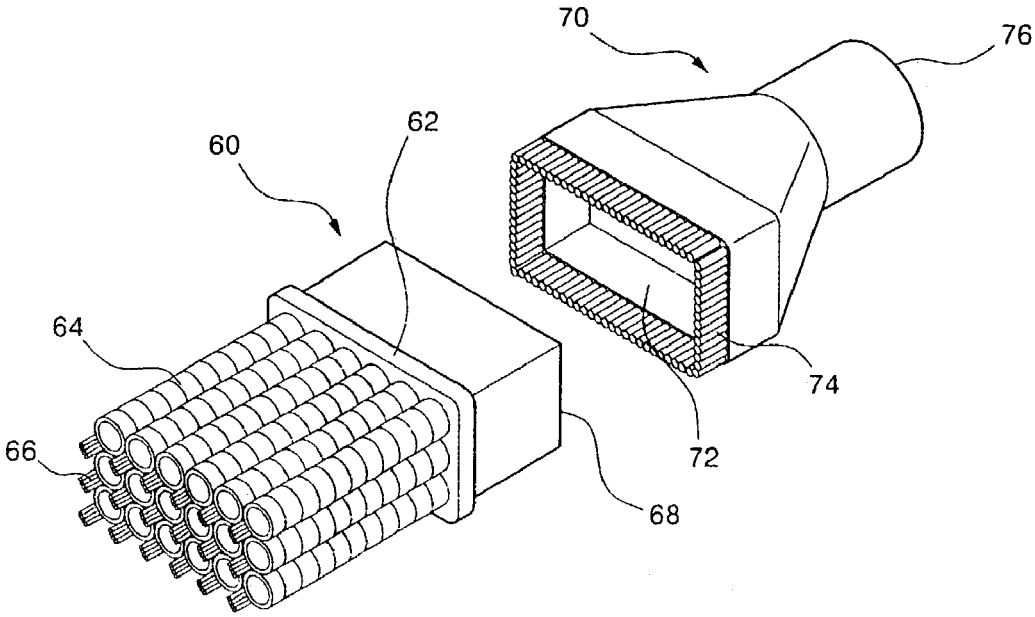
FIG. 4 is an exploded perspective view of the accessory tool for the vacuum cleaner according to the present invention.

An accessory tool for a vacuum cleaner according to the present invention is shown in FIGS. 3 and 4. As shown in the figures, the accessory tool 50 of the present invention comprises an octopus-leg like tool, or crevice tool, 60 for use in suction of dirt and dust in a small crevice, and a brush tool 70 to which the octopus-leg like tool 60 is detachably coupled.

An inlet 62 with a plurality of suction tubes 64 is formed at a front portion of the octopus-leg like tool, or crevice tool, 60. The suction tubes 64 come into direct contact with a crevice to be cleaned, and foreign substances are sucked therethrough by means of suction power of the vacuum cleaner (not shown). In the present embodiment, the suction tubes 64 are made of a flexible material. Therefore, since the suction tubes 64 are flexed in accordance with shapes or sizes of crevices to be cleaned, cleaning can be performed regardless of the crevices to be cleaned.

Further, a brush 66 is provided at a front portion of each of the suction tubes 64. Specifically, the brush 66 is provided at a periphery of the front portion of the suction tube 64, and made of a material more flexible than that of a brush 74 provided at the brush tool 70 to be described later. Therefore, in a case where a keyboard or the like is cleaned by using the octopus-leg like tool, or crevice tool, 60, the brushes 66 serve to sweep foreign substances such as dirt and the like on the keyboard and the suction tubes 64 serve to suck the foreign substances swept by the brushes 66.

Meanwhile, a coupling portion 68 is formed in the rear of the inlet 62. The coupling portion 68 communicates with the suction tubes 64 mounted in the front of the inlet 62. Therefore, in a case where the octopus-leg like tool, or crevice tool, 60 is coupled with the brush tool 70 to clean a small crevice such as in the keyboard, the suction power of the vacuum cleaner is transferred through the brush tool 70 up to the suction tubes 64 so as to suck the foreign substances from the outside.

An inlet 72 is formed at a front portion of the brush tool 70 to which the octopus-leg like tool, or crevice tool, 60 is detachably coupled, and the brush 74 is provided along a periphery of the inlet 72. In case of cleaning upholstery and the like, the brush 74 serves to sweep foreign substances on the upholstery, and the inlet 72 serves to suck the foreign substances swept by the brush 74.

The coupling portion 68 formed at a rear portion of the octopus-leg like tool, or crevice tool, 60 is constructed to be detachably coupled with the inlet 72 formed at the front portion of the brush tool 70. That is, the shape of the coupling portion 68 is determined such that it can be airtightly inserted into the inlet 72.

A connecting portion 76 is formed in the rear of the inlet 72. The connecting portion 76 is connected to one end of an extension tube (not shown) of the vacuum cleaner and communicates with the inlet 72. Accordingly, the suction power of the vacuum cleaner is transferred to a place to be cleaned, through the connecting portion 76 and inlet 72 of the brush tool 70 and the octopus-leg like tool, or crevice tool, 60, so as to suck foreign substances on the place.

Further, the tool 60 and the brush tool, or crevice tool, 70 are detachably coupled with each other in such a manner that the coupling portion 68 of the octopus-leg like tool, or crevice tool, 60 is inserted into the inlet 72 of the brush tool 70. In the present embodiment, both the coupling portion 68 and the inlet 72 are formed into tubes having rectangular cross-sections and are sized such that the coupling portion 68 can be inserted into the inlet 72.

In the meantime, in order to cause the suction power of the vacuum cleaner to be transferred up to the suction tubes 64 that are in contact with a place to be cleaned as described above, the coupling portion 68 should be airtightly coupled with the inlet 72 so that outside air is not introduced through a gap between their coupled portions to prevent loss of the suction power. Therefore, the coupling portion 68 and the inlet 72 are constructed such that an outer surface of the coupling portion 68 is in close contact with an inner surface of the inlet 72 and thus the suction power of the vacuum cleaner can be transferred to the suction tubes 64 without loss of the suction power.

Figure 5:
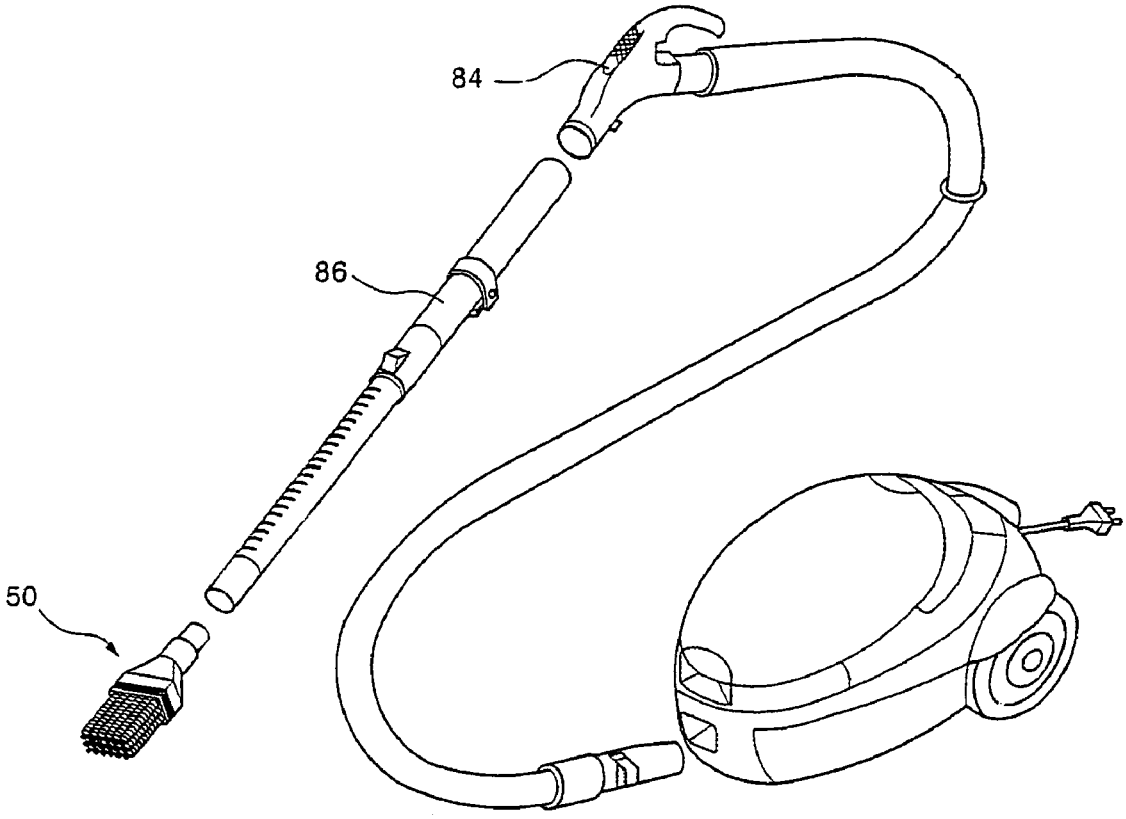
FIG. 5 is a perspective view of the vacuum cleaner to which the accessory tool of the present invention is coupled.

A cleaning operation of the vacuum cleaner using the accessory tool according to the present invention constructed as such will be described hereinafter with reference to FIG. 5.

Figure 1:
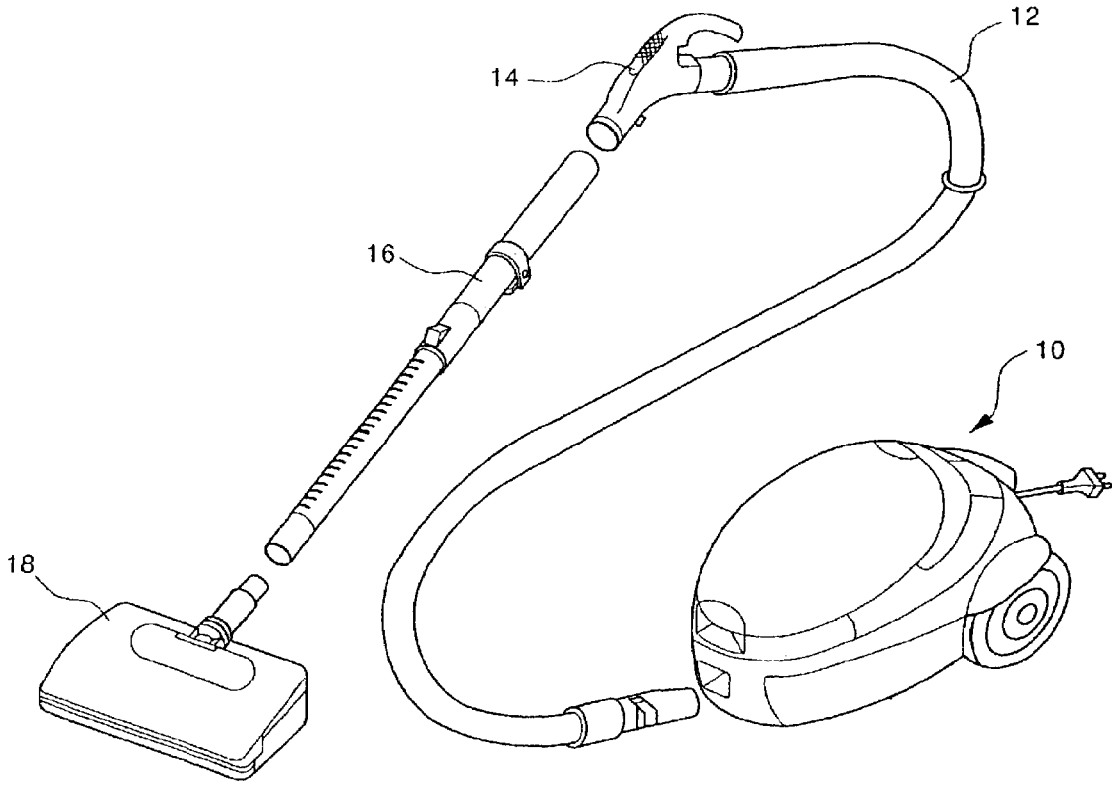
FIG 1 (PRIOR ART)
FIG. 1 is a perspective view of a general vacuum cleaner.
Figure 2A:
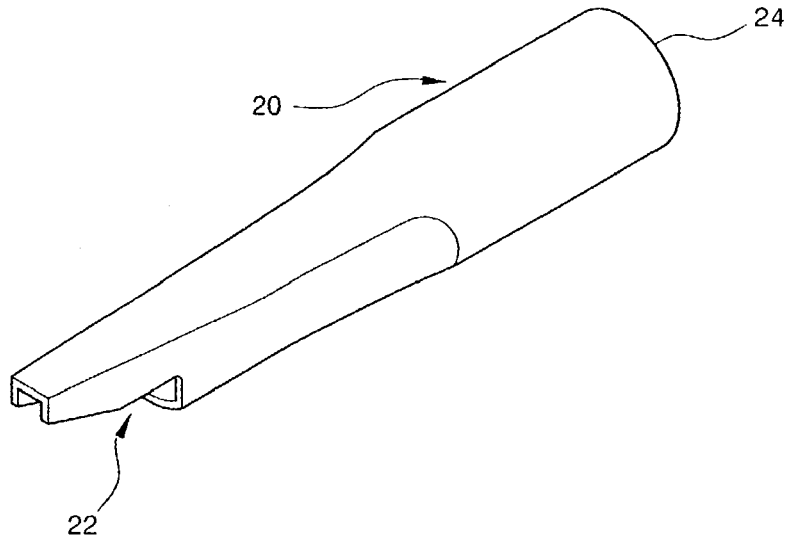
FIG 2a (PRIOR ART)
FIGS. 2*a* and 2*b* are perspective views of conventional accessory tools for the vacuum cleaner.
Figure 2B:
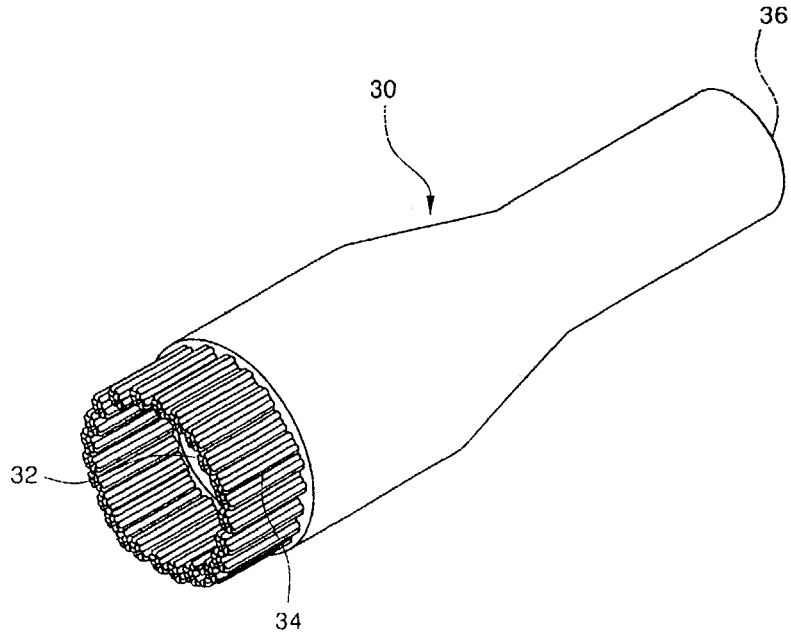
FIG 2b (PRIOR ART)

In case of cleaning a very small crevice such as in a keyboard of a computer or the like, the suction nozzle 18 (refer to FIG. 1) connected to one end of an extension tube 86 of the vacuum cleaner is first separated therefrom. Then, the octopus-leg like tool, or crevice tool, 60 is coupled with the brush tool 70, and the connecting portion 76 of the brush tool 70 is connected to the end of the extension tube 86. After the octopus-leg like tool, or crevice tool, 60 and the brush tool 70 are connected to the end of the extension tube 86 in such a way, the suction tubes 64 provided at the octopus-leg like tool, or crevice tool, 60 are placed in the crevice to be cleaned. Then, an operating handle 84 is manipulated to operate the vacuum cleaner.

When the vacuum cleaner is operated, the suction power of the vacuum cleaner is transferred through the brush tool 70 and the octopus-leg like tool, or crevice tool, 60 to the suction tubes 64 provided at the front portion of the octopus-leg like tool, or crevice tool, 60. Thus, foreign substances in the crevice to be cleaned can be sucked.

Furthermore, since the suction tubes 64 provided at the octopus-leg like tool, or crevice tool, 60 are made of a flexible material, they can be flexed in accordance with shapes or sizes of crevices to be cleaned so that a variety of places can be cleaned.

Further, the brushes 66 provided at the octopus-leg like tool, or crevice tool, 60 are also made of a flexible material to sweep foreign substances on places to be cleaned.

In case of cleaning upholstery or the like, the octopus-leg like tool, or crevice tool, 60 is separated from the brush tool 70 connected to the end of the extension tube 86. Then, the brush tool 70 is disposed on a surface of a place to be cleaned, and the operating handle 84 is manipulated to operate the vacuum cleaner.

When the vacuum cleaner is operated, foreign substances on the upholstery are sucked by means of the suction power of the vacuum cleaner. In this case, the brush 74 provided at the brush tool 70 sweeps the foreign substances on the upholstery so that the foreign substances can be easily sucked through the inlet 72 provided at the front portion of the brush tool 70.

It can be seen from the above description of the present invention that the basic technical spirit of the invention is to detachably couple the octopus-leg like tool, or crevice tool, which has the plurality of flexible suction tubes and brushes, with the brush tool with the brush.

As described above, the accessory tool for the vacuum cleaner according to the present invention enables cleaning of a small place by means of the octopus-leg like tool, or crevice tool, with the plurality of flexible suction tubes. Furthermore, since the octopus-leg like tool, or crevice tool, is detachably coupled with the inlet of the brush tool with the brush, it is possible to eliminate inconveniences of completely removing the accessory tool and coupling it again depending on features of places to be cleaned.

It will be apparent that those skilled in the art can make various modifications within the scope of the technical sprit of the invention. Further, the present invention should be construed based on the appended claims.

What is claimed is:

1. An accessory tool assembly for a vacuum cleaner, comprising:

a crevice tool, comprising a plurality of suction tubes extending in a forward direction from an inlet portion thereof, and a coupling portion formed to a rear of and in communication with the inlet portion; and a brush tool, comprising an inlet portion formed at a forward portion of the brush tool and configured to be detachably coupled to the coupling portion of the crevice tool, a brush provided along a periphery of the inlet portion of the brush tool, and a connecting portion formed to a rear of the inlet of the brush tool and in communication with the inlet of the brush tool and configured to connect the brush tool to an extension tube of a vacuum cleaner.

2. The assembly of claim 1, wherein the plurality of suction tubes are made of a flexible material.

3. The assembly of claim 1, wherein front faces of the plurality of suction tubes are provided with brushes made of a flexible material.

4. The assembly of claim 3, wherein the brushes extend beyond the front faces of the plurality of suction tubes.

5. The assembly of claim 4, wherein the brushes extend along only a portion of a periphery of the plurality of suction tubes.

6. The assembly of claim 1, wherein the crevice tool is operable when the respective inlet portions of the crevice tool and the brush tool are coupled via the coupling portion.

7. The assembly of claim 6, wherein the brush tool is operable when the crevice tool is decoupled from the brush tool.

8. The assembly of claim 1, wherein the connecting portion and the inlet portion of the brush tool are configured to transfer a suction force therethrough.

9. The assembly of claim 8, wherein the suction force is transferred from the brush tool to the plurality of suction tubes of the crevice tool when the brush tool and the crevice tool are coupled.

10. The assembly of claim 1, wherein brushes are provided at spaces formed between adjacent suction tubes of the plurality of suction tubes.

11. The assembly of claim 10, wherein a cross section of each of the plurality of suction tubes is substantially circular.

12. The assembly of claim 10, wherein the brushes extend beyond front faces of the plurality of suction tubes.

13. A vacuum cleaner comprising the accessory tool assembly of claim 1.

14. An accessory tool for a vacuum cleaner, comprising:

a brush tool having a rear end configured to be coupled to a suction tube of a vacuum cleaner, and a forward end having a brush; and a crevice tool having a rear end configured to be detachably coupled to the forward end of the brush tool, and a forward end configured to contact a cleaning area when the brush tool and the crevice tool are coupled, wherein the forward end of the brush tool is configured to contact a cleaning area when the brush tool and the crevice tool are decoupled, and wherein the crevice tool comprises a plurality of suction tubes formed at a forward portion of the crevice tool, wherein the plurality of suction tubes are made of a flexible material so as to substantially conform to a contour of an area to be cleaned.

15. The accessory tool for a vacuum cleaner of claim 14 wherein a suction force is transferred through the brush tool to the plurality of suction tubes of the crevice tool when the brush tool and the crevice tool are coupled.

16. The accessory tool for a vacuum cleaner of claim 14, further comprising brushes provided at front faces of the plurality of suction tubes and extending beyond the front faces of the plurality of suction tubes.

17. The accessory tool for a vacuum cleaner of claim 16, wherein the brushes extend along only a portion of a periphery of the plurality of suction tubes.

18. The accessory tool for a vacuum cleaner of claim 14, wherein brushes are provided at spaces formed between adjacent suction tubes of the plurality of suction tubes.

19. The accessory tool for a vacuum cleaner of claim 18, wherein a cross section of each of the plurality of suction tubes is substantially circular.

20. The accessory tool for a vacuum cleaner of claim 18, wherein the brushes extend beyond front faces of the plurality of suction tubes.

21. The accessory tool for a vacuum cleaner of claim 14, wherein the crevice tool is operable when the crevice tool and the brush tool are coupled.

22. The accessory tool for a vacuum cleaner of claim 21, wherein the brush tool is operable when the crevice tool is decoupled from the brush tool.

23. A vacuum cleaner comprising the accessory tool of claim 14.

* * * * *